United States Patent [19]

Beale, Jr. et al.

[11] Patent Number: 4,806,227

[45] Date of Patent: Feb. 21, 1989

[54] CARBON BLACK INHIBITION OF PITCH POLYMERIZATION

[75] Inventors: Alvin F. Beale, Jr.; Louis D. Hoblit, both of Lake Jackson, Tex.

[73] Assignee: The Dow Chemical Company, Midland, Mich.

[21] Appl. No.: 59,152

[22] Filed: Jun. 5, 1987

Related U.S. Application Data

[63] Continuation of Ser. No. 597,317, Apr. 6, 1984, abandoned.

[51] Int. Cl.[4] ..... C10C 1/00

[52] U.S. Cl. ..... 208/22; 208/23; 208/39

[58] Field of Search ..... 208/22, 23, 39; 252/502

[56] References Cited

U.S. PATENT DOCUMENTS

| | | | |
|---|---|---|---|
| 1,456,495 | 5/1923 | Sieurin | 252/502 |
| 2,148,133 | 2/1939 | Reuscher et al. | 252/502 |
| 2,270,181 | 1/1942 | Cole et al. | 252/502 |
| 2,826,507 | 3/1958 | Waddill | 252/502 |
| 3,112,208 | 11/1963 | Johnson | 252/502 |
| 4,339,328 | 7/1982 | Stadelhofer et al. | 208/23 |
| 4,438,059 | 3/1984 | Mollman et al. | 252/502 |
| 4,522,627 | 6/1985 | Gomi et al. | 208/39 |

FOREIGN PATENT DOCUMENTS

| | | | |
|---|---|---|---|
| 0065288 | 6/1978 | Japan | 252/502 |

*Primary Examiner*—H. M. S. Sneed
*Assistant Examiner*—Helane Myers

[57] ABSTRACT

There is disclosed pitch prepared from petroleum pitch, which is normally considered to be inferior to coal tar pitch, which petroleum pitch has properties to equal that of coal tar pitch. That is to say, that the softening points, the Conradson carbon, the toluene insolubles and the quinoline insolubles can be matched with those obtained from coal tar pitch. In addition the properties of the petroleum pitch can be varied to meet end user specifications.

8 Claims, No Drawings

CARBON BLACK INHIBITION OF PITCH POLYMERIZATION

CROSS-REFERENCE TO RELATED APPLICATION

This is a continuation of application Ser. No. 597,317, filed Apr. 6, 1984, now abandoned.

BACKGROUND OF THE INVENTION

While coal tar and petroleum pitches commonly used for electrode manufacturing have approximately the same softening points, the coat tar pitch is usually higher in Conradson carbon than petroleum pitch having the same softening point. The higher the Conradson carbon, the higher the product yield. The two pitches also have different quinoline insoluble portions with the coat tar pitch having, generally, a higher quinoline insoluble content than the petroleum pitch. In addition, the form of the quinoline insolubles in petroleum pitch is a different form than that in the coal tar pitch the latter being non-optically active.

Efforts to prepare petroleum pitch which would meet the specifications of coal tar pitch have been generally unsuccessful since the polymerization of the residual oil from which petroleum pitch is normally derived produces a pitch which has a quinoline insolubles (QI), of no more than 4 to 4.5, at which point there is phase separation and coking at the reactor walls. Thus petroleum pitch could not meet many coal tar pitch specifications which require that the QI's be in the range of 10 to 15%.

Thus it would be advantageous to provide a process which could employ petroleum pitch and meet the requirement specifications of coal tar pitch.

BRIEF DESCRIPTION OF THE INVENTION

In accordance with the present invention, it has been found that inclusion of carbon black, with or without the inclusion of a distillate from petroleum pitch to aid in dispersion of the carbon, prior to the normal distillation procedures used in the conversion of the residual oil to binder pitch, there can be obtained a petroleum ptich which has the same Conradson carbon, the same softening point, the same QI and toluene insolubles (TI) insolubles as coal tar pitch.

It has also found to be in accordance with the present invention that by varying the amount of additive and processing conditions one can prepare binder pitches having varying QI, TI's and softening points so as to provide compositions useful for forming fibers, powders and the like.

Additionally, in applying the invention to refinery operations, it is known that in a refinery the residue from the crude oil still goes to either the atmospheric gas oil still or the vacuum gas oil still. In either case, the overhead oils have a higher commercial value than the residual oils (from which petroleum pitch is obtained). It has been found (Examples 4 and 5) that the addition of dispersed particulate carbon to the crude oil still residue results in higher gas oil production and less residual oil as well as minimization of coking in the latter, providing a more desirable operation, more usable products and an ability to produce from petroleum a pitch meeting the specifications of coal tar pitch. Further, such addition also gives one the ability to alter the product to meet various user specifications, thus by varying the amount of carbon additive and time-temperature-pressure profile the specifications for potential end use such as fibers, electrically conductive powders and composites can be met.

In addition, it was found that the QI's, softening points and the TI's could be varied by varying the amount of this additive to the residual oil/petroleum pitch prior to distillation. Thus by employing the additive and changing the process variables there was opened a whole new area of potential uses for petroleum pitch.

In the conversion of residual oils to pitch there are basically three operations: (1) a distillation; (2) a cracking and polymerization; and (3) a second distillation. The cracking becomes sufficient at 270° C. to be significant. As cracking occurs, polymerization takes place and the molecular weight distribution of the species present changes. The molecular weight distribution is controllable (within limits) by the time-temperature and the time-pressure profiles when the temperatures are above 270° C. The purpose of the final distillation step is to provide a handleable product, depending upon the application for which the pitch was designed. The initial distillation of the bottoms is normally carried out by heating the bottoms to 250° C. to 400° C. with or without the aid of vacuum and/or inert gas sparge. Most often the initial distillation and the polymerization stages overlap since both distillation rate and cracking are temperature dependent.

In commercial operations it is frequently convenient to designate steps or stages in terms of pressure alterations. Thus the initial distillation is usually considered the portion of the process carried out at atmospheric pressure or less and prior to increasing the pressure on the system. It is acknowledged that varying amounts of cracking and polymerization take place at temperatures about 270° C. at the pressure encountered. The second step (sometimes omitted) is run at temperatures usually above 270° C. and pressures usually above atmospheric and up to several hundred pounds per square inch. The final step is another distillation step normally utilizing vacuum and/or inert gas spurge to adjust the softening point to the user specifications. Following this general procedure but adding various amounts of carbon black to the residual oil prior to carrying out the above steps a product is produced which has met and can meet the coal tar pitch binder specifications as well as specifications for other uses.

In addition, it was found that by varying the amount of the additive one can obtain different specifications which are also useful in various utilities such as forming fibers, powders and the like, some of which are useful as electrical conductors.

In fact, the addition of 0.01 to 2% carbon to a residual oil can result in a pitch approaching coal tar pitch. In addition it has been found possible to alter the properties in favorable and reproducible manner to accommodate the various properties desired for the end use such as fibers, powders and the like some of which have found utility as electrical conductors.

One schedule for treating a residual oil comprises a general schedule for treating petroleum residues when employing the essence of the present invention is with reference to naphtha bottoms a three unit operation:

1. distillation to remove the lights, distillation of course continues throughout entire thermal treatment but the first heating to 250° C. and above under vacuum, atmospheric or low pressure results in distillate vis-a-vis cracking and/or polymerization;

2. cracking and polymerization which begin at about 270° C. and continue throughout the further higher thermal treatment, under pressure and at reduced pressures;

3. softening point adjustment, a result of thermal treatment at about 300° C. with or without the flow of an inert gas a distillation at the 300° C. point.

Following this general schedule and adding carbon in accordance with the present invention, unexpectedly results in a petroleum pitch of high diversity of properties including the capability to meet coal tar pitch specifications as illustrated in the following examples.

DETAILED DESCRIPTION OF THE INVENTION

EXAMPLE 1

3631 grams of residual oil was charged to a reactor and the reactor heated to 250° C. at which time nitrogen was bubbled through the molten reactor contents at about 13.8 liters per minute. The nitrogen flow was continued for 81 minutes as the temperature was increased to 330° C. The condensables in the nitrogen stream were collected and reported as initial overhead. In each case, at 330° C., the reactor was shut in and the pressure allowed to build to 120 psi. At 120 psi the control valve opened and maintained that pressure. Over a 44 minute period the temperature was raised to 400° C. The reactor was maintained at 400° C. and 120 psi for 10 minutes. The condensable vapors issuing through the valve were collected and recorded as the cracking overhead condensables. The reactor was thereafter allowed to cool to 280° C. The pressure fell to about 60 psi by the time the reactor had cooled to 300° C. The pressure was slowly bled off through a manual valve until all pressure had been released. Following the let down of the pressure, nitrogen was purged through the molten product at a rate of 9.8 liters per minute and the condensable overhead product was collected, weighed and recorded as the weight of the final distillate. The lapsed time between the end of the 10 minutes at 400° C. to draining the reactor was 182 minutes. The following table reports the distillate and the reactor residue along with the softening points, the Conradson carbon and the TI and QI of this product.

| | Grams |
|---|---|
| Residual Oil | 3631 |
| Initial overhead | 1282 |
| Cracking overhead condensables | 163 |
| Final distillate | 375 |
| Final product | 1668 |

The product had a softening point of 124° C., Conradson carbon of 56.8%, a TI of 31.3% and a QI of 1.4%.

EXAMPLE 2

This example was run in exactly the same manner as the above example and the table set forth below reports the results. The major difference was that 0.4 gram of Huber N299 carbon black was charged prior to initial heating.

| | | |
|---|---|---|
| Feed | 3733 | grams residual oil and |
| | 0.4 | gram Huber N299 carbon black |
| Initial overhead | 1292 | grams |
| Cracking overhead condensables | 136 | grams |
| Final distillate | 475 | grams |
| Final product | 1701 | grams of product |

The product had a softening point of 128° C., Conradson carbon of 57.0%, a TI of 31.8% and a QI of 0.4%.

EXAMPLE 3

To 3430 grams of residual oil in the reactor there was added 100 grams of Huber N299 carbon black which had been premixed with 392 grams overhead from an earlier run in a Waring blender. The procedure of Example 1 was followed with the following exceptions. The reactor was shut in at 150° C. and the pressure allowed to build up to 120 psi at which level it was maintained until cool down. The temperature was raised to 440° C. over 225 minutes, and maintained at 440° C. for 55 minutes. The pressure was maintained at 120 psi during the 440° C. interval. There was collected 1362 grams of overhead which included the 392 grams which had been added with the carbon black. The reactor, upon cooling to 360° C., was pressure relieved and the nitrogen purge at 8.9 liters per minute commenced. The purge resulted in 431 grams of additional overhead during this period. One hour had elapsed between the end of the 55 minutes at 440° C. and the completion of the collection of the 431 grams of overhead. 1789 grams of product were drained from the reactor. The product had a softening point of 119° C., a Conradson carbon of 59.7%, a TI of 42.7%, and a QI of 18.1%. There was no coking evident in the reactor as a result of operating the process in this manner.

The addition of the particulate carbon to the residual oils prior to its conversion to pitch has the following effect:

1. The formation of QI (mesophase) is substantially inhibited.
2. The size of mesophase which is produced is diminished from that obtained without the addition of the carbon.
3. Coking of the equipment is reduced or eliminated.

The carbon materials which can be added to the petroleum pitch to accomplish the results set forth above are; impure acetylene black, Cabot BP 2000, Cabot Vulcan XC 72 and Huber N299, all being carbon blacks of high surface area carbon. Equivalents of these materials may also be used.

In considering the observed phenomena associated with the addition of carbon to a high temperature hydro-carbon system, it is believed that this technique is applicable to refinery operations to increase liquid overhead production and minimize fouling of the equipment. In order to look into this possibility, the following experiment was run.

EXAMPLE 4

The versatility of the present process is illustrated by two experiments in which a quantity of residual oil having an API gravity of 14.1, a specific gravity of 0.9718 and a density of 0.9713 was treated according to the following schedule one with 1% by weight carbon added and the other without carbon addition.

Identical weights of residual oil from the crude oil processing plant were charged to a vacuum distillation set-up. In one case the oils alone were vacuum distilled. In the other case, 1% by weight of Huber N299 carbon black was added to the oil and the mixture was vacuum distilled. These were distilled at reduced pressures and a given temperature profile.

The data for the two runs (in the following tables) show the results obtained when carbon is added vis-a-vis no carbon and the distillation carried out to produce the same amount of overhead It should be noted that the softening point of the sample with added carbon is lower, its Conradson carbon is lower and yet the weight of residue is lower. Had the runs been taken to the same softening points, it is expected that more overhead would have been obtained from the sample containing carbon.

RESIDUAL OIL ONLY (No added carbon)

| TIME | OVH (°F.) | POT (°F.) | VAC (mmHg) | VARIAC | % RECOVERY (ml) | ATMOS. TEMPERATURE (°F.) |
|---|---|---|---|---|---|---|
| 10:58 | 200 | 354 | 0.5 | 60 | 0 IBP | 535 adjusting vacuumed bleed |
| 11:55 | 334 | 412 | 0.2 | 80 | 13 5% | 745 |
| 12:17 | 418 | 478 | 1.2 | 100 | 26 10% | 785 |
| 12:24 | 474 | 518 | 0.85 | 100 | 52 20% | 870 some smoke |
| 12:33 | 514 | 556 | 1.0 | 100 | 78 30% | 915 |
| 12:47 | | | | 110 | 100 | |
| 12:49 | 557 | 587 | 0.95 | 110 | 104 40% | 975 |
| 13:00 | 607 | 643 | 0.90 | 110 | 130 50% | 1035 |
| 13:08 | 607 | 660 | 0.90 | 120 | 140 | 1035 |
| 13:17 | 661 | 714 | 1.5 | 120 | 156 60% | 1085, heat off - considerable smoke 160 ml = final volume distilled |
| | | | | | END POINT | 2 ml in cold trap |

| Initial Weight | | Final Residue Weight | |
|---|---|---|---|
| 443.5 g sample + flask | | Residue weight + flask | 296.9 g |
| −193.5 g Flask | | empty flask | −193.5 g |
| 250.0 g sample weight | | residue weight | 103.4 g |

RESIDUAL OIL WITH 1% CARBON (HUBER) ADDED

| TIME | OVH (°F.) | POT (°F.) | VAC (mmHg) | VARIAC | % RECOVERY (ml) | ATMOS. TEMPERATURE (°F.) |
|---|---|---|---|---|---|---|
| 9:49 | 178 | 380 | 1.0 | 60 | 0 IBP | 505 |
| 10:05 | 381 | 455 | 1.25 | 80 | 13 5% | 735 |
| 10:12 | 439 | 485 | 1.15 | 100 | 26 10% | 814 |
| 10:18 | 490 | 528 | 1.0 | 100 | 52 20% | 883 |
| 10:25 | 533 | 561 | 1.0 | 100 | 78 30% | 938 |
| 10:32 | 563 | 614 | 1.0 | 110 | 100 | |
| 10:34 | 579 | 614 | 1.0 | 110 | 104 40% | 1010 |
| 10:41 | 628 | 660 | 1.25 | 110 | 130 50% | 1055 |
| 10:45 | 649 | 690 | 1.25 | 120 | 140 | 1080 |
| 10:50 | 690 | 730 | 1.25 | 120 | 156 60% | 1135 heat off 160 ml = final volume distilled |
| | | | | | 70% END POINT | |

| Initial Weight | | Final Residue Weight | |
|---|---|---|---|
| Sample + Flask | 479.6 g | Residue + Flask | 331.3 g |
| Empty Flask | −229.6 g | Empty Flask | −229.6 g |
| Sample Weight | 250.0 g | Residue Weight | 101.7 g |

The addition of a small percent particulate carbon to a system wherein pitch-type polymerization is occuring appears to inhibit the formation of the higher molecular weight species. This resulted in lower quinoline insolubles and lower Conradson carbons in the pitch products than observed in the run being compared under identical time-temperature-pressure-sparge rate profiles but had no added carbon. It was also observed that the carbon addition tended to prevent the agglomeration of the mesophase particles, thereby minimizing fouling and coking.

We claim:

1. A process for preparing a petroleum pitch for forming fibers consisting essentially of:

(a) adding from about 0.01 to less than 1 weight percent carbon black to a liquid petroleum residual oil to inhibit the formation of mesophase to from 0.2% to 1.4% quinoline insolubles and to inhibit fouling and coking during conversion of the residual oil to pitch, (b) heating the residual oil containing carbon black at a temperature and pressure sufficient to crack and polymerize molecular weight species of the oil, and (c) cooling the heated liquid mass to form a precursor composition for forming fibers.

2. The process of claim 1 wherein the temperature is between about 300° C. and about 450° C.

3. The process of claim 1 wherein the pressure is at subatmospheric, atmospheric or superatmospheric.

4. The process of claim 1 wherein nitrogen is sparged through the liquid petroleum residual oil during the heating step.

5. The process of claim 1 wherein nitrogen is sparged through the heated liquid mass during the cooling step.

6. The process of claim 1 wherein the carbon black has a surface area greater than 80 $m^2/gm$.

7. The process of claim 1 wherein the liquid petroleum residual oil is naphta bottoms.

8. A fiber-forming precursor petroleum pitch having a QI of from 0.2% to 1.4%, a softening point between 110° C. and 150° C., a Conradson carbon of greater than 50% and a TI of between 25% and 50% containing, in the predistillation state, from about 0.01% to less than 1% by weight carbon black and 0 to 20% distillate from petroleum pitch.

* * * * *